US011761167B2

(12) United States Patent
Cámara Puerto et al.

(10) Patent No.: US 11,761,167 B2
(45) Date of Patent: Sep. 19, 2023

(54) AUTOMATIC DEPTH CONTROL SYSTEM

(71) Applicant: The Charles Machine Works, Inc., Perry, OK (US)

(72) Inventors: Victor D. Cámara Puerto, Stillwater, OK (US); Benjamin Ryan Travers, Argyle, TX (US)

(73) Assignee: The Charles Machine Works, Inc., Perry, OK (US)

( * ) Notice: Subject to any disclaimer, the term of this patent is extended or adjusted under 35 U.S.C. 154(b) by 373 days.

(21) Appl. No.: 17/037,970

(22) Filed: Sep. 30, 2020

(65) Prior Publication Data

US 2021/0095438 A1 Apr. 1, 2021

Related U.S. Application Data

(60) Provisional application No. 62/993,761, filed on Mar. 24, 2020, provisional application No. 62/907,818, filed on Sep. 30, 2019.

(51) Int. Cl.
*E02F 5/14* (2006.01)
*E02F 5/06* (2006.01)

(52) U.S. Cl.
CPC ..... *E02F 5/145* (2013.01); *E02F 5/06* (2013.01)

(58) Field of Classification Search
CPC ..... E02F 5/145; E02F 5/06
See application file for complete search history.

(56) References Cited

U.S. PATENT DOCUMENTS 3,371,964 A * 3/1968 Weber ..... E21C 35/10 299/1.1
3,727,332 A 4/1973 Zimmer
4,050,171 A 9/1977 Teach
5,685,668 A * 11/1997 Justice ..... E02D 19/18 405/129.75
5,999,865 A * 12/1999 Bloomquist et al. ..... G05D 1/0248 701/25
6,016,616 A 1/2000 Geelhoed
6,954,999 B1 * 10/2005 Richardson et al. ..... E02F 5/02 701/50
7,695,071 B2 * 4/2010 Jackson et al. ..... E21C 35/24 299/1.05
8,042,290 B2 10/2011 Hartwick
(Continued)

OTHER PUBLICATIONS

Ditch Witch, "Service Instructions Setup and Calibration Trench Depth Meter" catalog, Sep. 2004, 7 pages.
(Continued)

*Primary Examiner* — Tara Mayo
(74) *Attorney, Agent, or Firm* — Tomlinson McKinstry, P.C.

(57) ABSTRACT

A system for uncovering a desired and pre-planned trench. A trenching machine is equipped with sensors, including visual imaging sensors. The sensors detect the inclination of the ground and movement of the trenching machine, as well as the angle of a trenching boom. Using this information, and a pre-determined preferred trench grade, a processor commands the trenching boom to adjust its angle to maintain the preferred trench grade. Surface irregularities may therefore be accounted for along the length of the trench to maintain a constant grade at the trench bottom.

20 Claims, 11 Drawing Sheets

(56) References Cited

U.S. PATENT DOCUMENTS 8,775,083 B2 7/2014 Young et al.

OTHER PUBLICATIONS

Ditch Witch, "Installation Instructions Trench Depth Meter Kit" catalog, Dec. 2004, 6 pages.
Ditch Witch, "Trench Depth Meter—Support" catalog, Oct. 2003, 24 pages.

* cited by examiner

AUTOMATIC DEPTH CONTROL SYSTEM

SUMMARY

The present invention is directed to a method. The method comprises designating a preferred excavation dimension for a first location and using one or more scanning devices to collect imaging data from areas at and around the first location. The method further comprises excavating the ground at the location with a digging attachment carried by a self-propelled work machine. The position of the digging attachment is denoted by an excavating dimension. Using the imaging data, the digging attachment is positioned such that its position matches the preferred excavation dimension.

In another aspect, the invention is directed to a method. The method comprises determining a preferred excavation depth for a location. With a work machine carrying an elongate trencher boom, the ground is excavated at the location. While excavating the ground at the location, further steps are performed. A ground plane upon which the work machine is situated is identified. The inclination of the trencher boom is ascertained. One or more scanning devices are used to collect imaging data from areas around the work machine. The imaging data, ground plane, and inclination of the boom are used to adjust the boom inclination such that the boom's depth matches the preferred excavation depth.

In another aspect, the invention is directed to a method of using a work machine with an elongate boom equipped with a digging tool. The method comprises excavating a trench with the digging tool and using one or more scanning devices to collect imaging data from areas around the work machine and the trench. From the imaging data, a ground plane is identified upon which the work machine is situated. After identifying the ground plane the inclination of the boom is ascertained. Using the boom inclination and the identified ground plane, an estimated depth of the digging tool is calculated.

DETAILED DESCRIPTION

Figure 1:
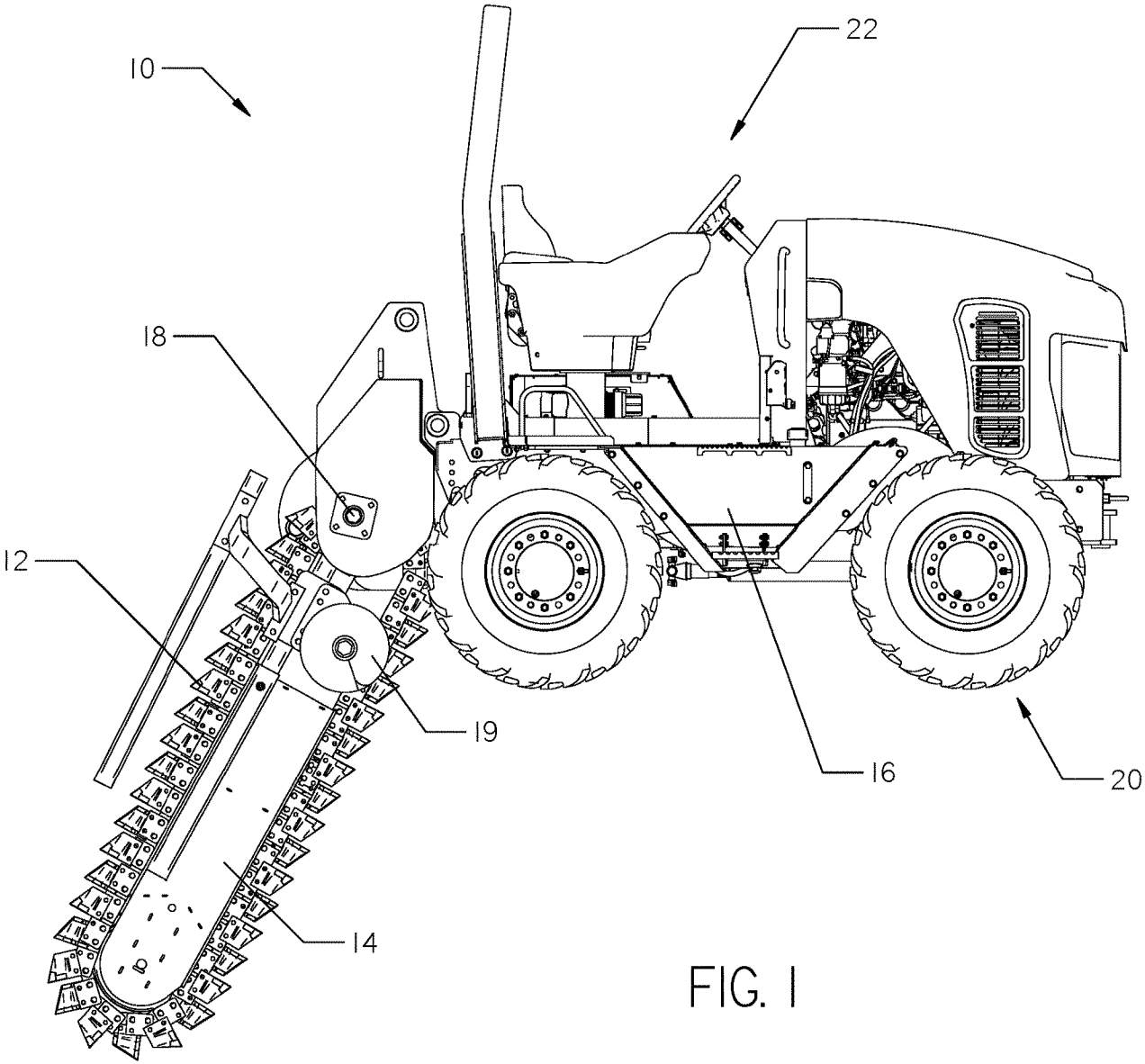
FIG. 1 is a side view of a trencher.

FIG. 1 shows a conventional ride-on trencher 10, of the type which may be used with the present invention. Trenchers, such as trencher 10, are work machines that use an endless chain 12 driven rotationally about a pivotal boom 14. The boom 14 may be pivoted relative to a vehicle chassis 16 about a pivot point 18 as the trencher moves across the ground surface to uncover a trench. One or more optional augers 19 are disposed near the pivot point 18 to move uncovered soil, or spoils, away from the trench. Motive elements 20, such as powered wheels or tracks, cause the trencher 10 to move across a ground surface.

An operator station 22 is typically located on the chassis 16 to allow an operator to access controls to operate the motive elements 20 and to actuate the trencher chain 12 and boom 14. As shown, this operator station 22 allows for seated operation, though standing platforms and pedestrian, or walk-behind configurations are also well known.

Trenches uncovered by trenchers 10 are typically used for underground construction, whether installation of utility lines or residential installations like sprinkler systems. An actuator (not shown) raises and lowers the trencher boom 14 about the pivot point 18. Dimensions of the trench, including trench depth and slope, may be adjusted by raising and lowering the trencher boom 14 in the ground. In many cases it may be desirable to cut a trench at a specified grade to accommodate the specific utility being installed. For example, sewer lines require installation at a specified slope to allow downhill flow. Alternatively, it may be desirable to cut a level trench with a zero grade.

Figure 2:
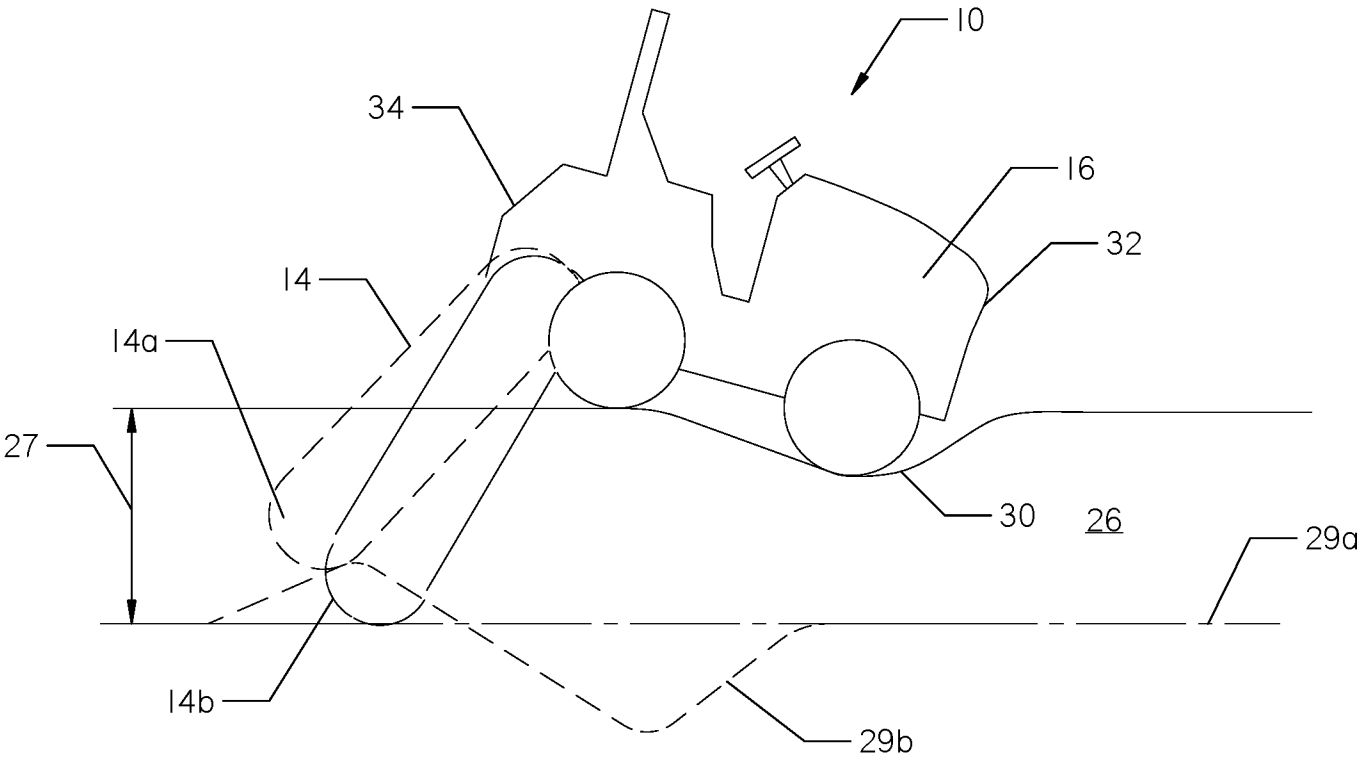
FIG. 2 is a side view of a trencher on uneven surface, with a desired trench represented by a repeating dash-dot pattern, and an actual trench represented by a dashed line.

FIG. 2 illustrates a trencher 10 traversing an uneven surface, and the problems that may occur. A trench 26 has a preferred trench profile which includes a target depth 27. When uncovering a trench 26 in a perfectly flat environment, the target depth 27 may be constant, or changing linearly along the trench path.

The illustration of FIG. 2 shows the desired bottom surface 29*a* shown in alternating dot-dash. However, a surface irregularity 30 will cause a first end 32 of the chassis 16 to dip downward. If the trencher boom 14 is maintained at a constant angle relative to the chassis 16, the end of the trencher boom 14 is lifted to position 14*a* (shown in dashed line). This lifting causes an unwanted raised portion of the trench 26, as shown in dash as an actual bottom surface 29*b*. Likewise, when a second end 34 of the chassis 16 encounters the surface irregularity 30, the end of the trencher boom 14 is too deep. The result is the uneven surface 29*b* shown.

It is preferable, therefore, to provide a system which collects or determines information about the surface of the ground encountered by the chassis 16 and motive elements 20. This information may be used to provide adjustments to the angle of the trencher boom 14 relative to the chassis 16. In FIG. 2, this is represented by the adjusted position of the digging chain 14*b*. By compensating for the surface irregularity 30 the actuator is adjusted to maintain the trencher boom 14 at a target excavation depth 27 that corresponds to the desired trench profile. It should be understood that the target depth 27 will vary with surface irregularities, even if the desired trench profile has a bottom with no grade.

Figure 3:
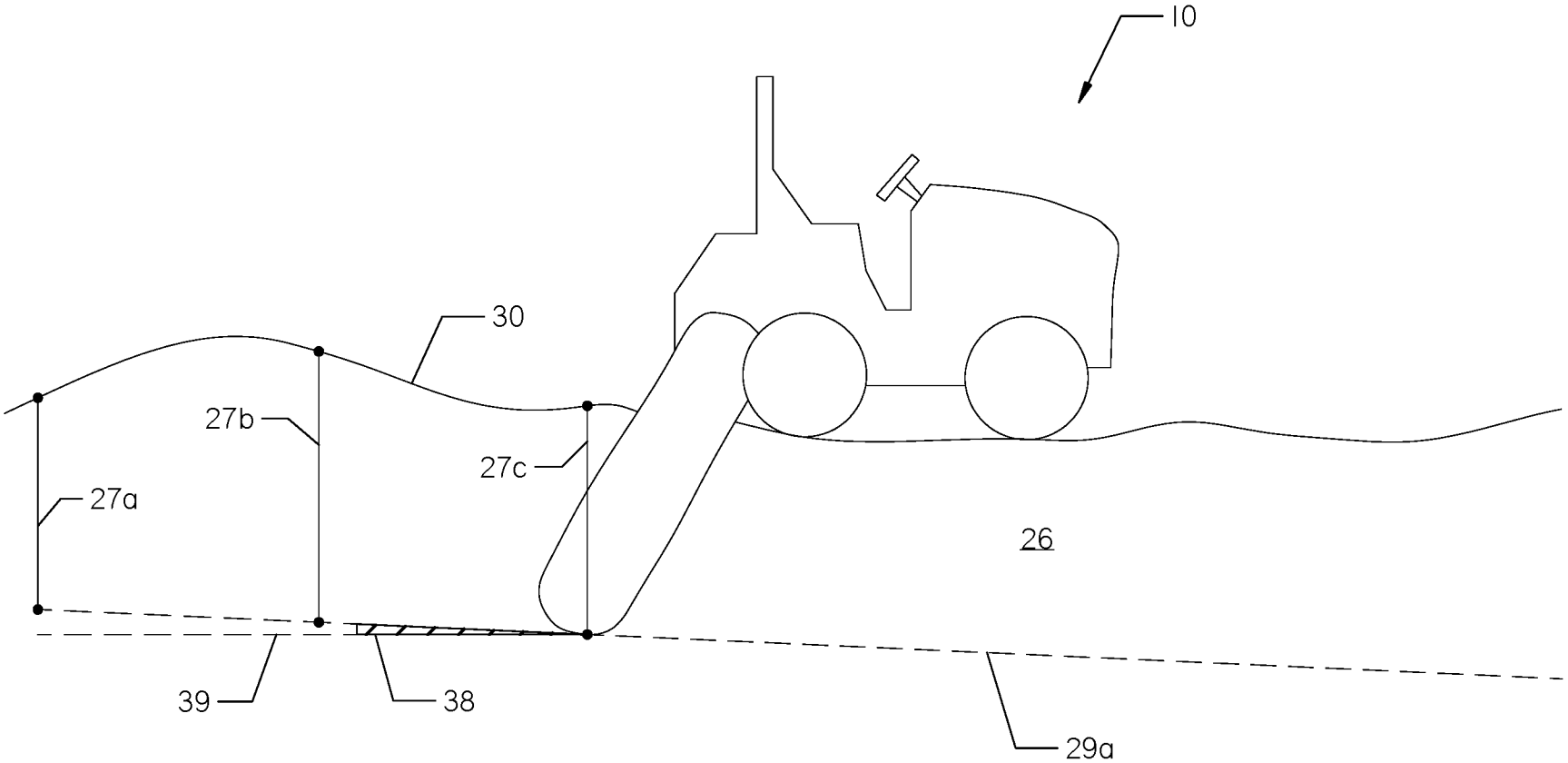
FIG. 3 is a side view of a trencher cutting an on-grade trench with a constant slope across uneven terrain.
Figure 4:
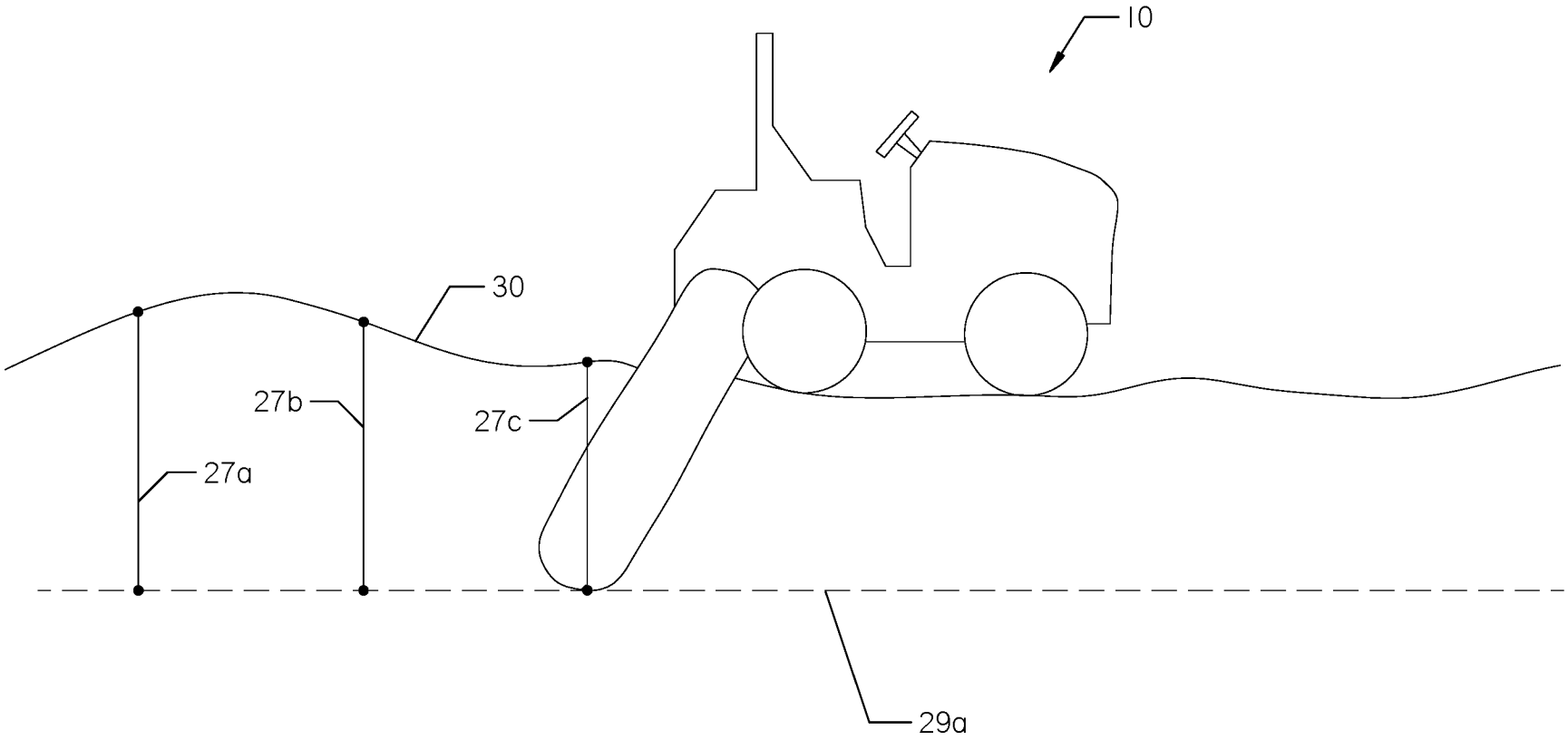
FIG. 4 is a side view of a trencher cutting a zero grade trench across uneven terrain.

With reference to FIGS. 3 and 4, the desired operation of trencher 10 is shown. In both FIGS. 3 and 4, the ground surface 14 comprises multiple surface irregularities 30. In FIG. 3, the desired bottom surface 29*a* associated with the trench profile is at a slight, constant slope, as indicated by angle 38 taken from horizontal reference line 39. The target depth thus changes from a first location indicated by line 27*a*, to a second location 27*b* and a third location 27*c* along the length of the trench 26. In FIG. 4, the same operation is shown, but with a desired bottom surface 29*a* having a horizontal or 0% grade.

Figure 5:
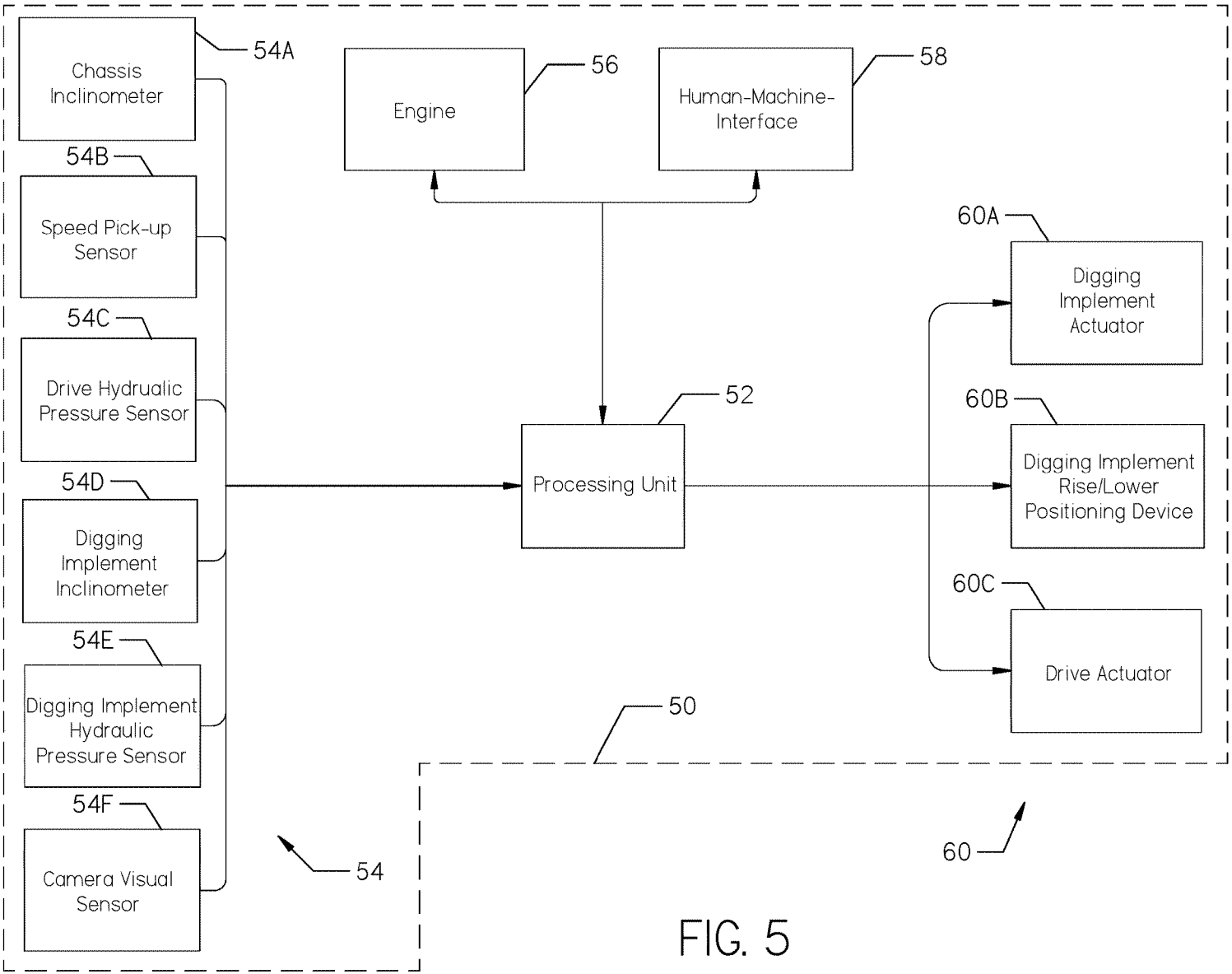
FIG. 5 is a block diagram representing a control system for use with the trencher described herein.

With reference to FIG. 5, the present invention provides automated electronics control system 50 that adjusts the depth of the trencher boom 14, compensating for terrain surface irregularities 30 to achieve a desired bottom trench surface 29*a* or depth profile 27. The control system comprises a processing unit 52, a set of sensor inputs 54, the machine engine 56, a human-machine interface (HMI) 58, and output controls 60.

The sensor inputs 54 may comprise one or more of a chassis inclinometer 54A, a speed pick-up sensor 54B, a drive hydraulic pressure sensor 54C, a digging implement inclinometer 54D, a digging implement hydraulic pressure sensor 54E, and a camera or visual sensor 54F.

Inclinometers 54A, 54D are used to determine the absolute angle, relative to horizontal, of the chassis 16 and trencher boom 14, respectively. Additional information about inclinometers 54A, 54D and their use is given in reference to FIG. 7.

The speed pick-up sensor 54B is used to determine the rate at which the chassis 16 is advancing, which is related to the rate at which the trench 26 advances. Pressure sensors 54C, 54E are used to determine digging rate and to monitor components for the risk of stalling. Visual sensor 54F provides visual confirmation of both surface irregularities 30 and the actual trench.

The sensor inputs 54 communicate information to the processing unit 52, which is also in two-way communication with the machine engine 56 and the HMI 58. The HMI 58, in particular, will receive information about the trench and measured conditions for an operator's consideration. Additionally, an operator may use the HMI 58 to indicate to the processing unit 52 changes to the desired trench profile.

The machine engine 56 may receive signals from the processing unit 52 if changes to power available to hydraulic components will be required, for example. Likewise, if engine 56 load indicates that a stall or other failure mode is imminent, the processing unit 52 may make adjustments accordingly.

The processor thus uses the inputs of the sensor inputs 54, engine 56 and HMI 58 to determine how to actuate the output controls 60 to compensate for the terrain irregularities. These output controls 60 may include one or more of the trencher boom 14 actuator 60A for raising and lowering the boom, a hydraulic motor 60B for rotating the trenching chain 12 about the boom 14, and one or more motors 60C for actuating the motive elements 20. While trenchers 10 are discussed here, other controls 60 may be utilized for alternative digging implements, such as plow and saw blades, without departing from the spirit of this invention.

Figure 6:
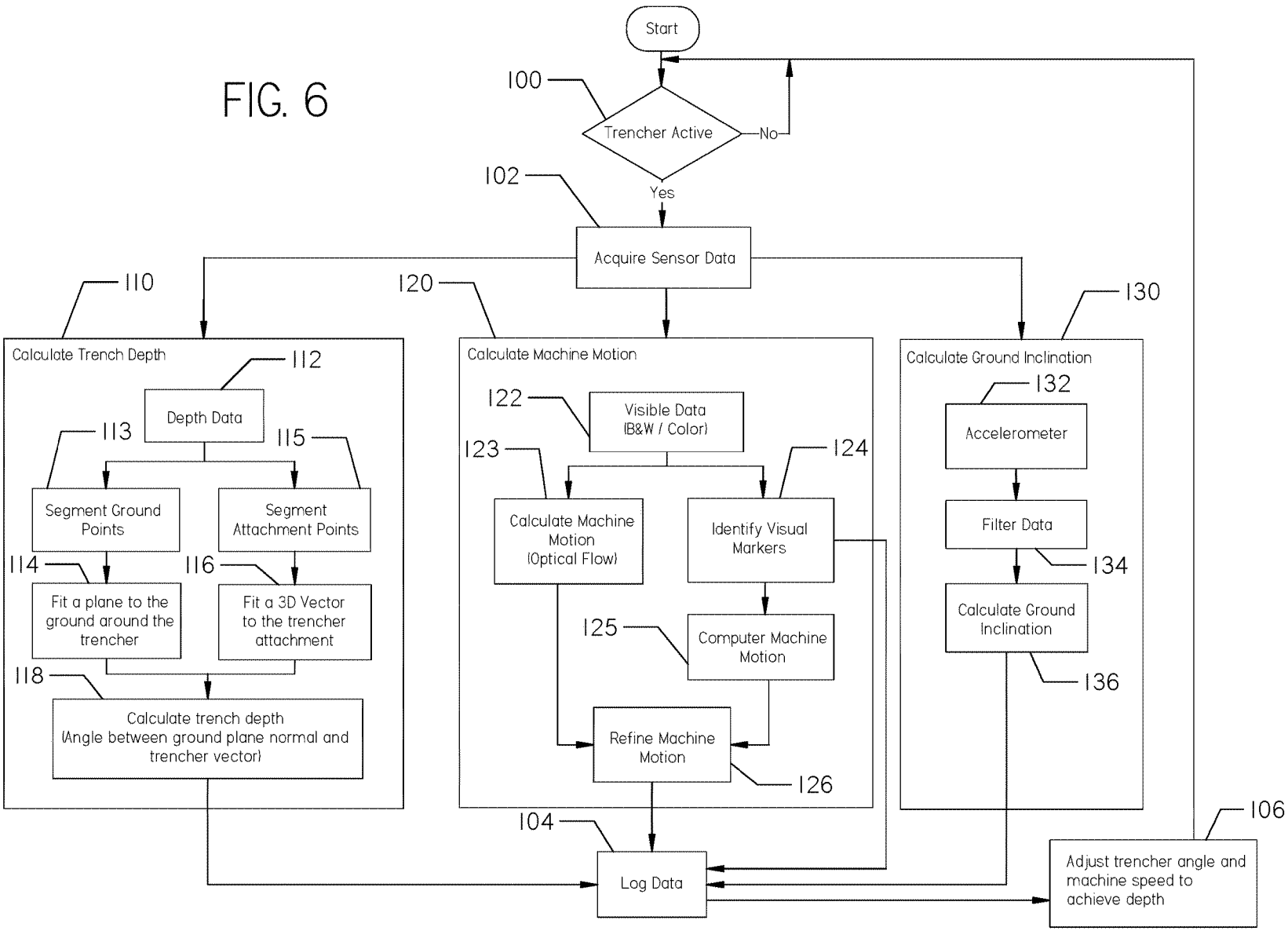
FIG. 6 is a flow chart of a depth control system utilizing a visual sensor, including the control logic for acquiring visual and positional data.

A flow chart showing operation of the control system is shown in FIG. 6. When the trencher is active at 100, the processor 52 seeks to acquire sensor data at 102, which is logged at 104. This sensor data is broadly categorized in three modules: trench depth 110, machine motion 120, and ground inclination 130. By acquiring such data, the processing unit 52 can adjust the trencher boom 14 and machine speed to match the desired trench profile input by the HMI 58.

The trench depth module 110 acquires depth data at 112 by plotting segment ground points at 113, fitting a plane to the ground around the trencher at 114. Simultaneously, segment attachment points are plotted at 115 and a 3D vector is fit to the trencher attachment at 116. The plane and vector are then used at 118 to calculate trench depth for logging by the processor at 104. In FIG. 8B, an example is shown of a trencher line 64 which intersects the ground plane 66, indicating that a trench is being uncovered by the trencher boom 14.

Various sensors may be used to acquire the data necessary for the trench depth module 110. These may include the visual sensor 54F, digging implement inclinometer 54D, chassis inclinometer 54A and the like.

Figure 8A:
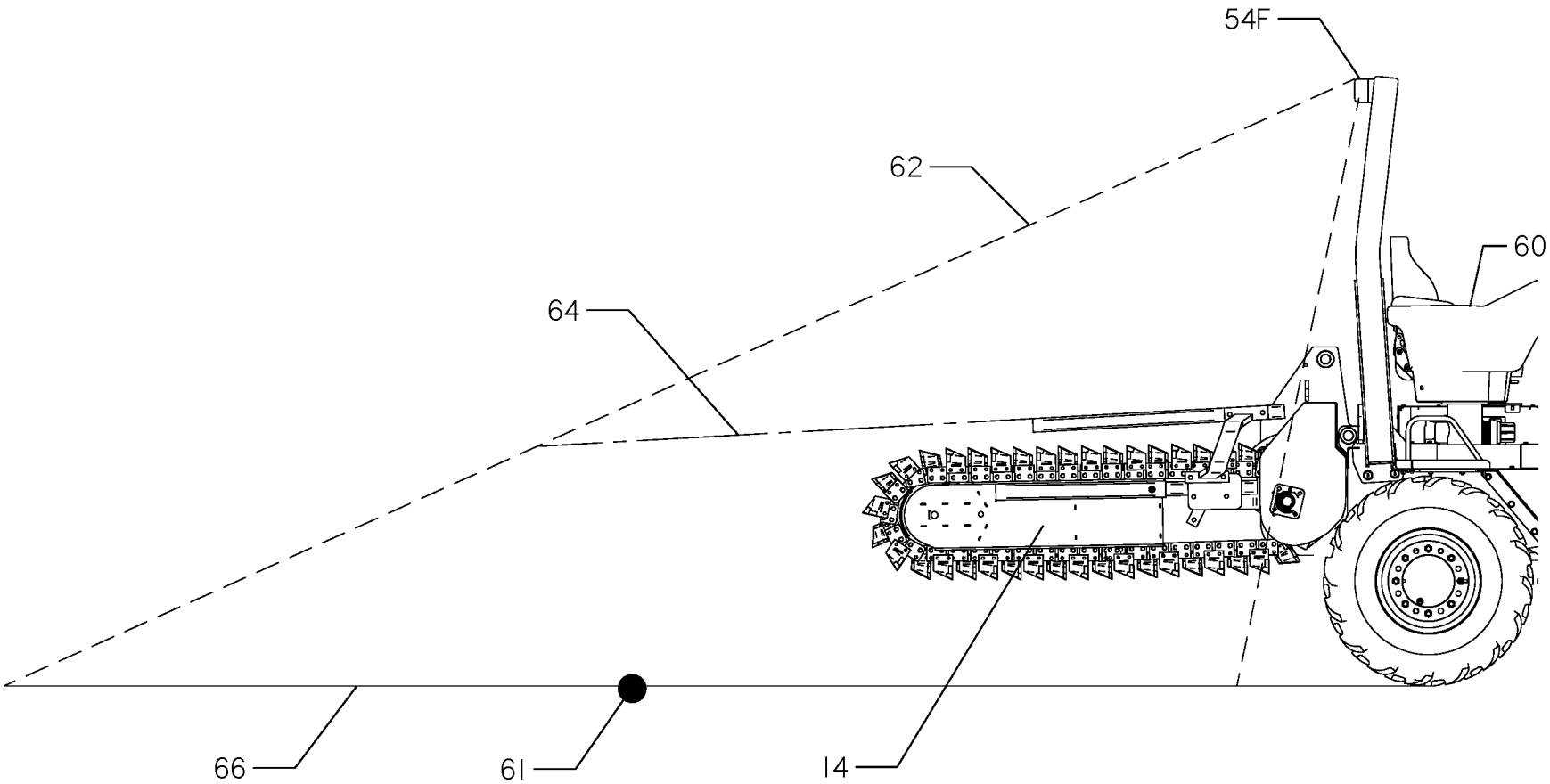
FIG. 8A is a side view of a trencher having a visual sensor for use with depth logging and the control system described herein. The trencher boom is shown in a raised position.
Figure 8B:
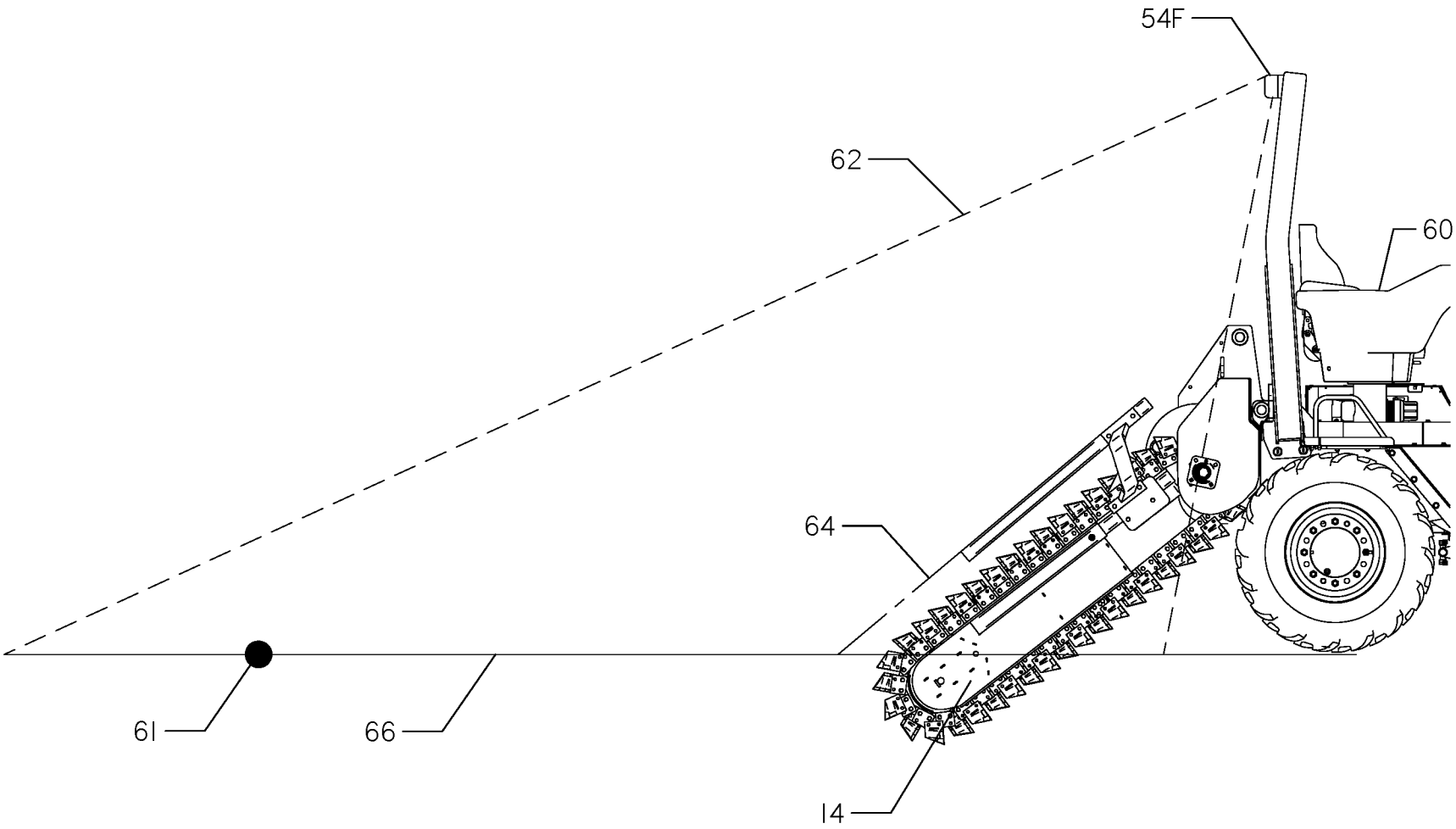
FIG. 8B is the trencher of FIG. 8A with the trencher boom in a lowered position.

The visual sensor or camera 54F is attached to the rollover protection structure 60 of a trencher chassis 16 as shown in FIGS. 8A-8B. Visual markers 61 can be placed in the field of view 62 of the visual sensor 54F. Such markers can be used for various purposes, as described above.

For example, a static marker 61 placed at a known location adds reference coordinates to "as trenched" data. A marker 61 could be placed at a surveyed point. Markers 61 also may be placed throughout a planned trench path, which can increase the accuracy of "as trenched data". Recording and saving such data allows "as trenched" data to be stitched together when work is performed at different times or different days. Additionally, multiple trenches in the same area can be included in a single dataset, such as when a sprinkler system is constructed using multiple trenching operations.

The camera 54F has a field of view 62, in which the ground surface 30 and trencher boom 14 are visible. In addition, the processor 52 may enable the camera 54F to provide meaningful location information about the trencher line 64 and the ground plane 66. The trencher line 64 is indicative of the inclination of the boom 14, and can be determined visually by the camera 54F.

The camera 54F may be have one or more spaced sensors, for example, a stereovision camera. Such a camera 54F acquires both a visible image (which may be color or black and white) and depth data. The visible image is used to determine machine 10 motion using optical flow and detect visual markers 61. The depth data is used to determine trench depth. Alternatively, the depth data may be acquired by using a laser or other tool for measuring the distance from a discrete point. This depth data may be overlayed on visual images to perform the methods discussed herein.

Returning to FIG. 6, the machine motion module 120 uses visual imaging data, such as that acquired by the visual sensor 54F, at 122, to determine the magnitude and direction of the motion of the trenching machine 10. Machine motion may be detected at 123 through an optical flow analysis. This is a standard technique that looks for features in two separate video frames and calculates how those features move between frames. This provides the trencher's relative motion.

The image is likewise scanned for the visual markers 61 (FIGS. 8A, 8B). Visual markers 61 are identified at 124 and machine motion is determined using this motion at 125. The orientation of these visual markers is calculated, relative to the camera. As the orientation of these visual markers are calculated relative machine motion is computed.

The information from these two parallel channels is combined to refine machine motion at 126. Optical flow can detect small machine movements but is subject to drift. Visual markers don't have drift but cannot be used to detect small machine movements. Combining these two data sets increases system performance.

The ground inclination module 130 uses accelerometer data, such as that detected by the chassis inclinometer 54A or the visual sensor 54F, to determine the orientation of the ground plane 66 underneath the motive elements 20. Data is gathered at 132 and filtered at 134. From the filtered data, the processor 52 is able to calculate ground inclination at 136 which is logged at 104.

The information logged through calculation by the modules 110, 120, 130 is used at 106 to match the desired trench profile. As discussed above, the trench profile is comprised of a preferred trench bottom grade. To maintain this grade, the depth of the trench may vary from location to location due to the surface irregularities 30.

Once the digging profile has been entered the operator may instruct the machine 10, through the HMI 58, to dig to the target depth. The machine 10 will start digging until the desired depth is reached. The processing unit 52 controls the necessary motion of the trencher boom 14 using the machine geometry, sensor readings 54A-54F and desired profile input at the HMI 58. Additionally, the processing unit 52 may control the digging rate by monitoring the hydraulic system pressure and engine load with sensors 54B, 54C, 54E to prevent the trencher chain 12 or other implement from stalling.

After the operator instructs the machine 10 to start moving, the processing unit 52 will adjust the speed of the machine to achieve a target productivity rate (speed of digging) based on the hydraulic pressure of the system and the engine load. The processing unit 52 monitors the plurality of inclinometer sensors and calculates the current depth of the trench. The calculated depth is analyzed to determine if the trencher boom 14 or other digging implement is at the target depth. If the digging implement is not at the target depth as the machine moves to a second location, the processing unit 52 actuates the implement to raise or lower the implement to the correct depth. This process, outlined above, is repeated while the digging operation is ongoing.

The operator can pause the job at any time. The machine 10 will resume operation once the operator commands to restart the job. The processor 52 will return the machine 10 to the target parameters and continue digging until the operator stops the operation. The system logs the location, speed and depth at select intervals. Once the job is completed the processing unit 52 stops the machine and saves the log.

A two-dimensional geometry plot may be created which shows the angle of the chassis 12 at each recorded interval. The geometry plot may therefore be used as a representation of the ground profile, and utilized to calculate the necessary trencher boom angle to achieve the desired trench depth given the variable elevation of the terrain and the angle of the trencher chassis 16.

Additionally, a $3^{rd}$ dimension can be added to the system with the addition of a compass or inertial measurement unit (IMU). The process of tracking the $3^{rd}$ dimension (heading) is the same as the ground profile, plotting the heading vs. the distance travelled.

Figure 7:
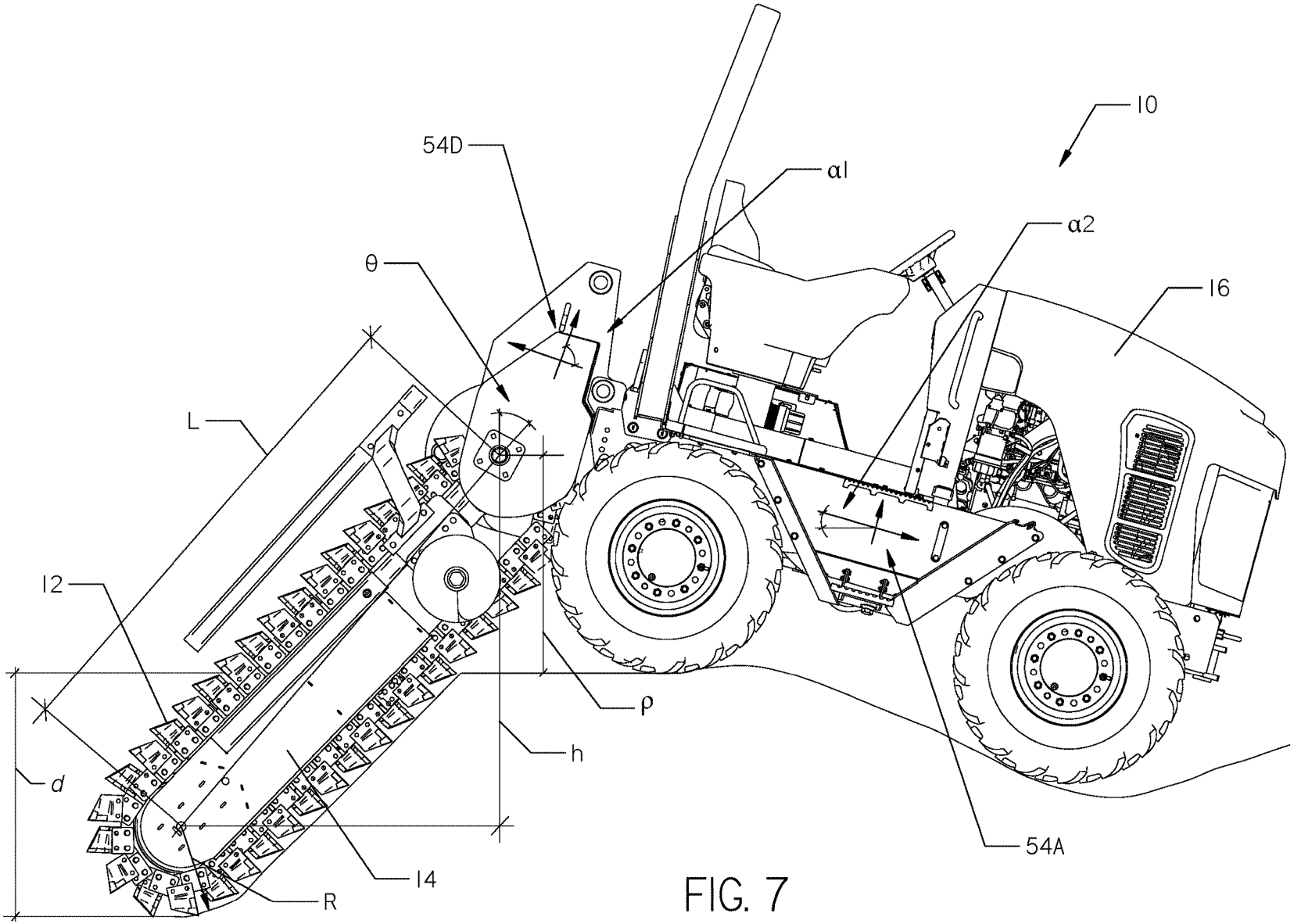
FIG. 7 is a side view of a trencher with reference lines representing various dimensional aspects thereof.

The depth profile is a dynamic calculation of the geometry of the chassis 16 and the boom 14 against the ground as illustrated in FIG. 7. The depth (d) of the trench can be calculated using known machine geometry and the angle of inclination of the trencher boom 14. The known measurements are the pivoting height (ρ), the boom length (L), and the digging chain 12 radius (R). The angle (θ) is calculated subtracting the inclinometer angle of the chassis ($\alpha_2$) from the inclinometer angle of the boom ($\alpha_1$) against the horizontal plane where these sensors are calibrated on the leveled tractor. An offset (Δ) is added to the inclinometer angle of the boom ($\alpha_1$) because the machine 10 is calibrated with the boom on the ground instead of completely horizontal.

$$d=(L\times\cos((\alpha_1+\Delta)-\alpha_2)-\rho+R$$

While a trencher boom 14 is described herein, it should be understood that the system described may be utilized for other digging tools, such as saw blades, microtrenching blades, plows, and the like.

Figure 9A:
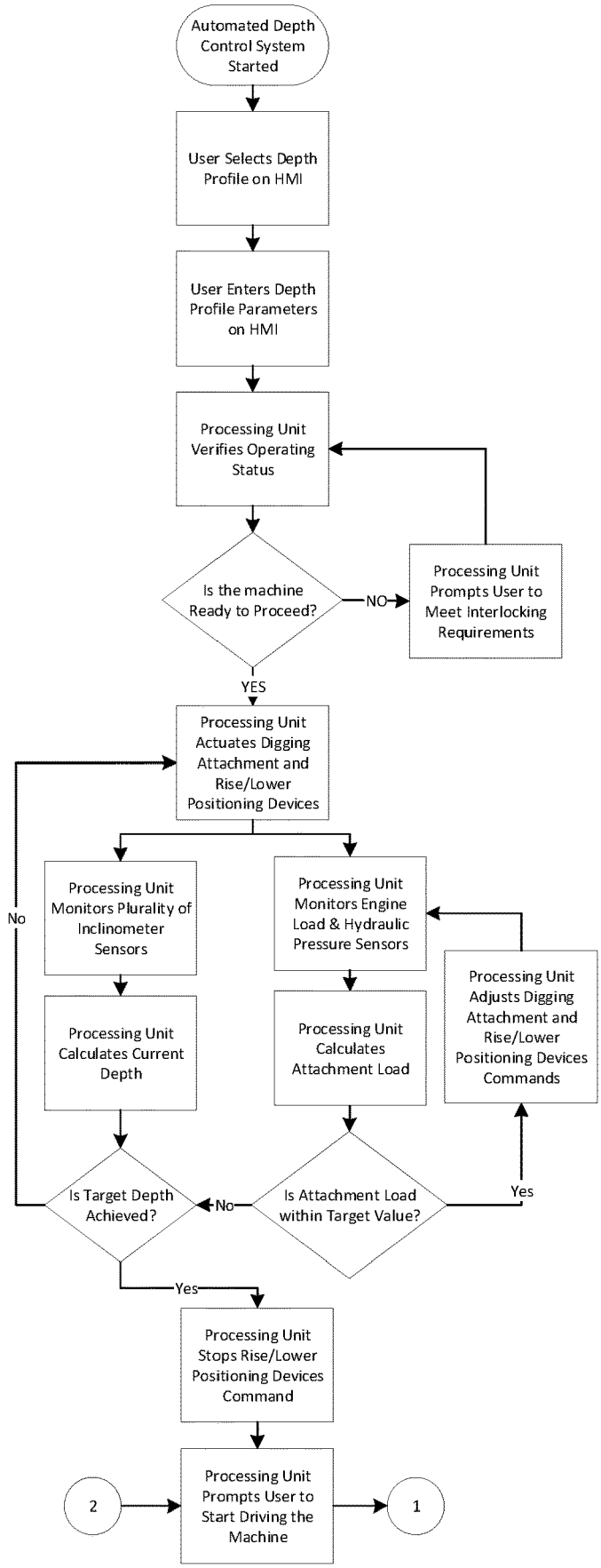
FIG. 9A is a flow chart showing logic of a processor which is accessed with a human-machine interface (HMI). The processor steps are achieving the initial target depth.
Figure 9B:
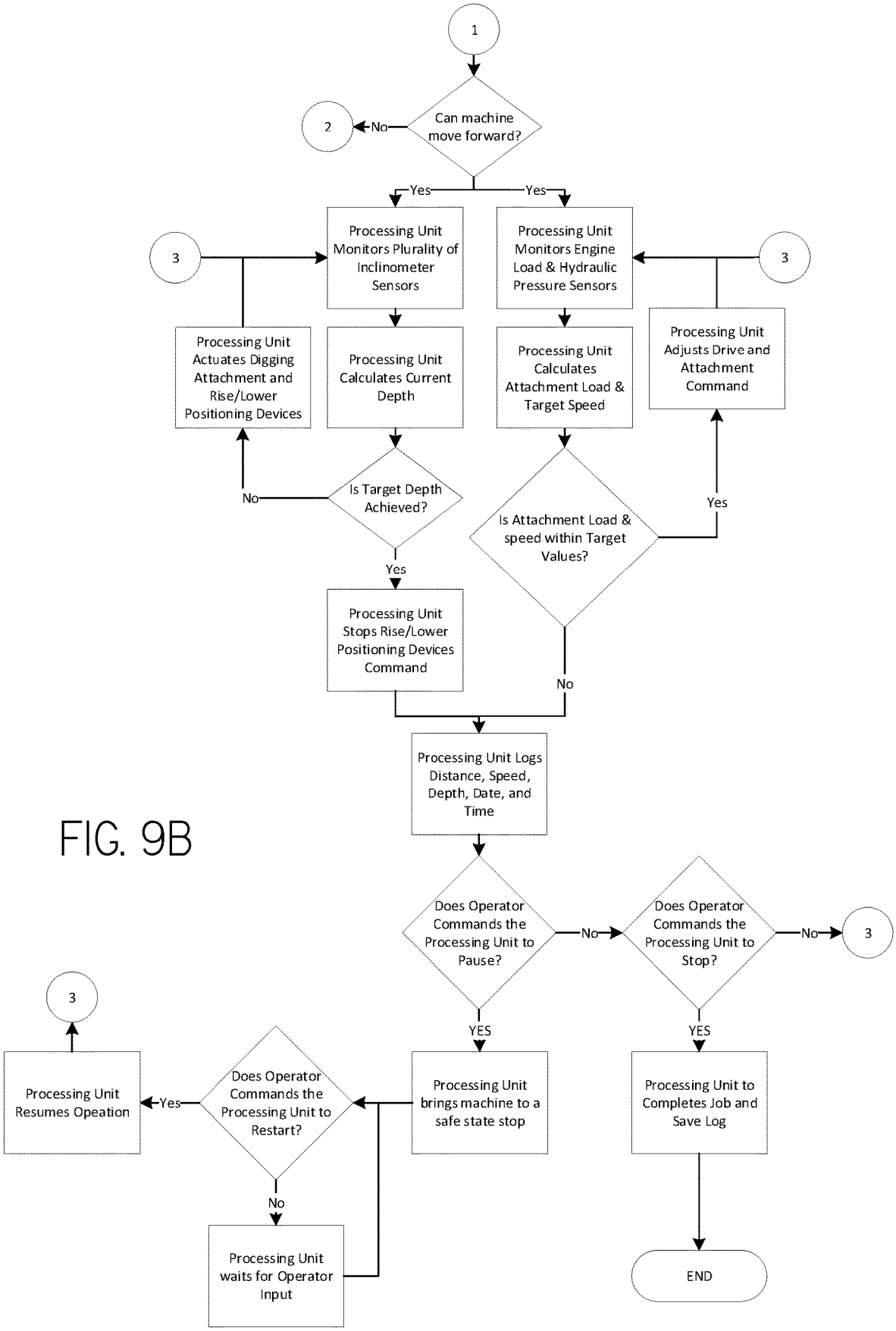
FIG. 9B is a flow chart showing logic of a processor during trenching operations.

FIGS. 9A and 9B show the general operation of the machine 10, including control logic for the depth control system disclosed.

Changes may be made in the construction, operation and arrangement of the various parts, elements, steps and procedures described herein without departing from the spirit and scope of the invention.

The invention claimed is:

1. A method comprising:

designating a preferred excavation dimension for a first location;

using one or more scanning devices to collect imaging data from areas at and around the first location;

excavating the ground at the location with a digging attachment carried by a self-propelled work machine, the position of the digging attachment being denoted by an excavating dimension; and using the imaging data, positioning the digging attachment such that its position matches the preferred excavation dimension.

2. The method of claim 1 further comprising;

prior to the positioning step, using one or more scanning devices to collect imaging data from areas at and around the first location;

using the imaging data, identifying a ground plane associated with the first location; and in which the step of positioning the digging attachment is carried out with reference to the identified ground plane.

3. The method of claim 1 wherein the preferred excavation dimension is an excavation bottom depth.

4. The method of claim 3 in which the excavation has a length, and in which the preferred depth of the excavation over the length results in a uniform grade along the excavation bottom.

5. The method of claim 1 in which the digging attachment is a trencher boom.

6. The method of claim 1 further comprising:

moving the self-propelled work machine away from the first location to a spaced second location, the second location having a preferred excavation dimension;

using one or more scanning devices to collect imaging data from areas at and around the second location; and using the imaging data, positioning the digging attachment such that its position matches the preferred excavation dimension for the second location.

7. The method of claim 1 in which the step of adjusting the digging attachment comprises:

changing an angle of the digging attachment relative to the self-propelled work machine.

8. The method of claim 1 in which the image data comprises a visible image.

9. The method of claim 1 in which the image data comprises a three dimensional plot.

10. The method of claim 1 further comprising:

placing one or more visual markers along a path of the excavation; and capturing the location of the one or more visual markers in the image data.

11. A method comprising:

determining a preferred excavation depth for a location;

with a work machine carrying an elongate trencher boom, excavating the ground at the location;

while excavating the ground at the location, performing the steps of:

identifying a ground plane upon which the work machine is situated;

ascertaining the inclination of the trencher boom;

using one or more scanning devices to collect imaging data from areas around the work machine; and using the inclination of the trencher boom, the identified ground plane, and the collected imaging data, adjusting the boom inclination such that the trencher boom's depth matches the preferred excavation depth.

12. The method of claim 11 in which the image data comprises representations of visual markers having known locations relative to the excavation.

13. The method of claim 11 in which the image data comprises frame-to-frame optical flow data captured during the uncovering of the excavation.

14. The method of claim 11 further comprising:

with a hydraulic system, providing power for translation of the work machine and uncovering of the excavation by the trencher boom;

monitoring the hydraulic system pressure; and adjusting the speed of translation of the work machine in response to the hydraulic system pressure.

15. The method of claim 14 in which translation of the work machine is slowed in response to increased hydraulic system pressure.

16. The method of claim 11 in which the image data is captured by a stereovision sensor.

17. The method of claim 11 in which the location is one of a series of locations, each location having a preferred excavation depth, the excavated locations defining a path of constant grade.

18. A method comprising:

excavating the ground with a digging attachment of a self-propelled work machine;

detecting the inclination of the ground surface underlying the work machine;

using the ground surface inclination, positioning the digging attachment as required to maintain it at a desired depth; and using one or more scanning devices on the machine to collect imaging data about the excavation.

19. A method of using a work machine having an elongate boom equipped with a digging tool, comprising:

excavating a trench with the digging tool;

using one or more scanning devices to collect imaging data from areas around the work machine and the trench;

from the imaging data, identifying a ground plane upon which the work machine is situated;

after identifying a ground plane, ascertaining the inclination of the boom; and using the boom inclination and the identified ground plane, calculating an estimated depth of the digging tool.

20. The method of claim 19 in which a predetermined depth for the trench is chosen for the trench before the excavating step, and further comprising:

after calculating the estimated depth, changing the inclination of the boom as required to match the depth of the digging tool to the predetermined depth.

* * * * *